United States Patent [19]

Günther

[11] 4,045,699

[45] Aug. 30, 1977

[54] USE OF LIGHT-METAL PANES AS X-RAY TRANSMISSIVE WINDOWS

[75] Inventor: Stefan Günther, Erlangen, Germany

[73] Assignee: Siemens Aktiengesellschaft, Berlin & Munich, Germany

[21] Appl. No.: 607,874

[22] Filed: Aug. 26, 1975

Related U.S. Application Data

[63] Continuation-in-part of Ser. No. 475,144, May 31, 1974, abandoned.

[30] Foreign Application Priority Data

June 19, 1973 Germany ..... 2331210

[51] Int. Cl.[2] ..... H01J 35/00

[52] U.S. Cl. ..... 313/59; 250/505

[58] Field of Search ..... 313/59, 95; 250/505, 250/506, 213 VT

[56] References Cited

U.S. PATENT DOCUMENTS

| | | | |
|---|---|---|---|
| 2,665,391 | 1/1954 | Bleeksma | 313/59 |
| 2,955,219 | 10/1960 | Niklas | 313/95 |
| 3,287,581 | 11/1966 | Rome et al. | 313/59 |
| 3,419,741 | 12/1968 | Legendre | 313/59 |

*Primary Examiner*—Davis L. Willis

*Attorney, Agent, or Firm*—Hill, Gross, Simpson, Van Santen, Steadman, Chiara & Simpson

[57] ABSTRACT

A light-metal pane usable as an X-ray transmissive or penetrable window which is constituted of a material readily permitting the passage of X-rays therethrough. The window pane is obtained through the use of a two-layer material, of which one layer is formed of light-weight metal, and the other layer comprises a heavy-weight metal. In the ray transmitting portion of the window, the heavy-weight metal layer is removed, and at the edge the light-weight metal, so that there remains the two-layer material in the transitional region towards the edge of the window.

8 Claims, 2 Drawing Figures

USE OF LIGHT-METAL PANES AS X-RAY TRANSMISSIVE WINDOWS

CROSS-REFERENCE TO RELATED APPLICATIONS

This application is a continuation-in-part application of Ser. No. 475,144; filed May 31, 1974 and now abandoned.

FIELD OF THE INVENTION

The present invention relates to the use of light-weight metal panes as X-ray transmissive or penetrable windows. Windows of this type are, as known, utilized for X-ray tubes, as well as for high-vacuum tubes in which X-rays are generated which are employed externally of the tube. Windows are also required for tubes in which X-rays or similar penetrating rays, such as the gamma rays of isotopes, are converted into electrical, optical signals and the like, and which allow for the ready through-passage or transit of the rays. Tubes of this type may contain suitable measuring probes, or arrangements by means of which the rays are rendered visible. Such tubes, for example, are known as image converters, television receiver tubes and the like.

DISCUSSION OF THE PRIOR ART

Presently known metal windows for X-rays are frequently constructed of beryllium, since the latter provides for an excellent passage therethrough of these rays. The panes are soldered or welded to the housing which they are intended to close through the intermediary of bonding elements, having particular reference to Legendre U.S. Pat. No. 3,419,741 and German Published Pat. application No. 1,464,377. However, beryllium panes, at this time and in the current state of the technology, are available only in limited dimensions and, moreover, are difficult to work, while being quite expensive. For many applications of X-ray windows, such as for use in X-ray image intensifiers, besides inexpensive materials, there is also a need for large dimensions or diameters and an enhanced degree of freedom in the working thereof. As a rule, vacuum image amplifiers currently are provided with windows which are formed of glass.

Thus, Legendre U.S. Pat. No. 3,419,741 relates to the vacuum-tight fastening of a thin beryllium window. Pursuant to Column 1, lines 38 to 40, the disclosure proceeds from X-ray windows formed of cellophane, aluminum or beryllium. The further development only relates to beryllium windows and their fastening to a vacuum tube formed of glass. Beryllium plates which are usable as windows for X-rays, in the present state of the art, are obtainable in only limited sizes or dimensions. Moreover, shaping of that type of window is not readily possible. Both conditions, however, restrict the applicability of that type of window primarily to locations in which one deals with small diameters and, mainly, with planar windows. The foregoing renders it impossible to use that type of windows for X-ray image intensifiers which have, as is known, large inlet surfaces. Additionally, beryllium windows are expensive, so as to inhibit their use in metal windows, in particular those having large diameters. In Legendre, the vacuum-sealed beryllium window is introduced into a vacuum tube through the use of intermediate means. In particular, there is provided a special frame and a flange, unlike the inventive two-layered material which is worked upon to provide the window structure without the need for a special connection between the frame portions.

German Specification No. 1,464,377 describes a vidicon-image converter tube for taking X-rays in which the inlet window consists of beryllium, as in Legendre. This window is also applied and fastened to a flange and fails to provide for the coating of the rim or edge.

Image-amplifying tubes which are adapted to render visible X-rays and isotope images must be provided with inlet windows having large diameters so as to be applicable to the image measuring encountered in the X-ray and isotope diagnostic practice. It is, however, quite difficult to durably mount windows having satisfactory ray transitional capacities in a vacuum sealed relationship in the wall of the bulb or tube. In accordance with a previous proposal, the window was constructed of a thin metal foil, such as titanium, and enclosed within a rigid or sturdy frame which was, for example, formed of steel. Thereby, the outer rim of the foil is welded to the outer rim of the frame. The metal foils for this purpose require, on the one hand, a degree of stability suitable for the wall portion of the vacuum bulb or tube and, on the other hand, to be weldable to heavy metal. Consequently, only thin sheets of heavy-weight metal, such as titanium, come into consideration therefor. However, the foregoing has indicated that, upon evacuation, the window bends into the interior of the bulb. This configuration is detrimentally at odds with respect to the usual construction of an image amplifier element, and leads to undesirably lengthy image converter tubes. Light-weight metals or alloy windows of adequate stiffness are not weldable at the edges thereof, such as through the argon-arc process, to the heavy-weight metal used as the frame for the bulb or tube construction, as for instance, in Eberlein U.S. Pat. No. 3,878,417, which merely describes the fastening or mounting of a foil as a window. The foil is then located on a frame, and the edges of the foil and frame welded to each other.

Additionally, bulbs which are entirely constituted of aluminum, in effect of a light-weight metal, have not been suitable, since usable lead-throughs for electrical conduits through the aluminum walls have not as yet been attained, having reference, for example, to Philips Techn. Rundschau 21.Jg. (1959/60) Nr 10, Page 272. In this instance, the window is without a frame, directly a portion of the wall of the bulb or tube. Thereby, this construction does not evidence a frame of a heavy-weight metal.

In a known X-ray image amplifier or intensifier having gas chamber-encompassing walls which are formed of a plastic material, the wall through which X-rays penetrate is constructed of aluminum sheet. However, such a wall without doubt restricts the passage of X-rays, so that the combination of a lead layer and aluminum sheet fails to form a window of adequate ray penetrability. The foregoing is also employed as a photocathode, in which there is carried out a conversion of the X-rays into electrons. This is subject to the prerequisite that the X-rays be absorbed, since otherwise no conversion can be expected. Thus, the known inlet for X-rays presents a converter unit which consists of aluminum sheet fully coated with lead as, for example, in German Laid-Open Pat. Application No. 1,439,270. The publication merely describes an X-ray image intensifier in which a plastic material housing includes a ray inlet window constituted of aluminum.

There is no disclosure of a window structure in which the window plate consists of light-weight plate covered at the edges thereof with a heavy-weight metal.

Bleeksma U.S. Pat. No. 2,665,391 discloses a window formed of a plate and frame requiring each a vacuum-tight connection. Such connections are reduced superfluous by the inventive two-layered material.

Niklas U.S. Pat. No. 2,955,219, while disclosing a window of the above-mentioned type, does not show a method of insertion thereof, but only suggests that, in lieu of glass, there may also be employed beryllium or aluminum as the materials for the window. There is no disclosure of the inventive two-layered material.

SUMMARY OF THE INVENTION

Accordingly, it is an object of the present invention to provide a novel and advantageous construction for a ray-transmitting window, whose pane consists of a light-weight metal which is weldable into a heavy-weight metal frame, and wherein in a simple manner suitably shapeable panes of large dimensions may be inexpensively obtained.

The foregoing object is inventively solved by means of light-weight panes, excluding beryllium, which are coated along the rim portions thereof with a weldable heavy-metal, and used the window panes for high-vacuum tubes, readily weldable to heavy-weight metal and evincing superior X-ray penetrating properties.

Due to the present invention, the advantage is obtained in that the ray-penetrable pane may be constructed of inexpensive materials such as, for example, aluminum and the alloys thereof. The materials are, as known, obtainable in suitable plate sizes at favorable prices. In addition thereto, such materials may be readily shaped or formed. The thus constructed windows may thereby be outwardly bent or curved, so that for a good ray-penetrating capability, sufficiently rigid forms may be obtained. Additionally obtainable are the advantages of a heavy-weight metal frame, which may form the transition piece to a glass or heavy-metal bulb or tube.

In the embodiment of the invention, the window is obtained through the use of a two-layer material, of which one layer is formed of light-weight metal and the other layer comprises the heavy-weight metal. Heavy-weight metal, within the scope of the present invention, is a metal which does not readily transmit X-rays, but which is advantageous in providing the stiffness or rigidity needed in vacuum pistons or bulbs, and is weldable to the material of the bulb. Contrastingly, a light-weight metal is such which permits the satisfactory passage of X-rays at a corresponding stability, so as to be insertable in the wall of a high-vacuum piston or bulb as a window pane. The border between heavy-weight and light-weight metal lies at about a density or specific weight of 4.5 g/cm$^3$ as defined in the technology (Lexicon der Technik und der exakten Neturwissenschaft; Meyers; Bibliographisches Institute; Mannheim/Wien/-Zurich). In the ray transmissive portion of the window, the heavy-weight metal is removed and at the edge the light-weight metal, so that at the transition region toward the edge there remains the two-layer material. An applicable layered material, which contains aluminum as the light-weight metal and copper as the weldable material, is commercially obtainable as material sold under the registered trademark "Kupal." The material "Kupal" consists of a commercial product formed by rolling together, under high pressure, an aluminum sheet and a copper sheet to produce a two-layer sheet which is integrally connected or laminated. Herein the aluminum has a density of 2.7 g/cm$^3$ and the copper 8.9 g/cm$^3$. In lieu of the foregoing, aluminum alloys and titanium of 4.5 g/cm$^3$ may be employed as light-weight metals. As the heavy-weight metals, in lieu of copper, there may be used nickel (8.9 g/cm$^3$), and iron or steel (7.8 g/cm$^3$). The thickness of the layers is selected in dependence upon the size of the window and upon the required stiffness. For a 17 cm-image amplifier, in effect, meaning for a window which has an inlet surface of 17 cm in diameter, material has been applicable in which the light-weight metal is 1.3 mm thick aluminum, and the rim material which is welded to the steel is 0.5 mm thick copper. The welding operation is carried out, in an advantageous manner, in accordance with the argon-arc process.

In lieu of copper, the two-layered material may be constituted of iron and aluminum, in which the aluminum has the same properties as in Kupal, and wherein the iron replaces the copper portion.

The weldable material may usually be removed from the center portion of the window through turning on a grinding bench or lathe, as well as the light-weight metal material along the edge or rim. Other methods are also applicable by means of which one of the material layers may be removed. This may, for example, be a mechanical process such as sanding, scraping and the like, or a chemical process such as etching, heating and the like.

BRIEF DESCRIPTION OF THE DRAWINGS

Reference may now be had to exemplary embodiments of the invention, taken in conjunction with the accompanying drawings, in which.

DETAILED DESCRIPTION

Figure 1:
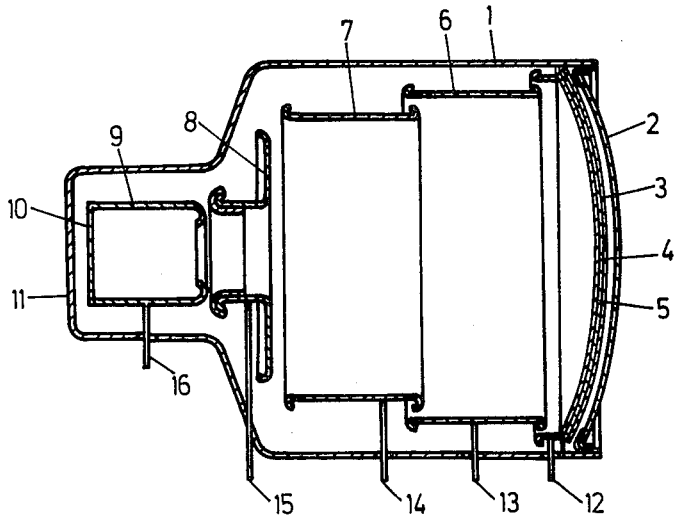
FIG. 1 is a generally schematic sectional view of an X-ray image intensifier or amplifier, having a window inventively mounted therein.

Referring now in detail to FIG. 1 of the drawing, a bulb or tube 1 of an image amplifier, which is constructed of steel, includes a ray inlet window 2 which consists of aluminum sheet having a thickness of 1.3 mm. Behind the window 2 is located a cathode arrangement consisting of an aluminum calotte 3, an irradiating layer 4, and a photocathode layer 5. Positioned behind the cathode, interiorly of the tube 1, are electrodes 6, 7, 8 and 9. In that connection, electrode 9 is the anode which is on the side thereof, facing away from the photocathode consisting of elements 3 through 5, has the arrangement of the electrodes 6 through 9 closed off by the illuminating screen 10 which extends in parallel with the end wall of bulb or tube 1. Herein the end wall 11 is formed of glass and is transparent so that the image appearing on the screen may be readily viewed. The image amplifier is, in a known manner, placed into operation through the application of a voltage to the inlet conduits 12 through 16, which are insulatedly conveyed through the wall of tube 1, whereby upon the entry of X-ray beams through the window 2, electrons are released in the cathode arrangement 3 through 5 and imaged through the intermediary of electrodes 6 through 9 on the illuminating screen 10, so that an illuminated image appears thereon which may be viewed through the window or end wall 11.

Figure 2:
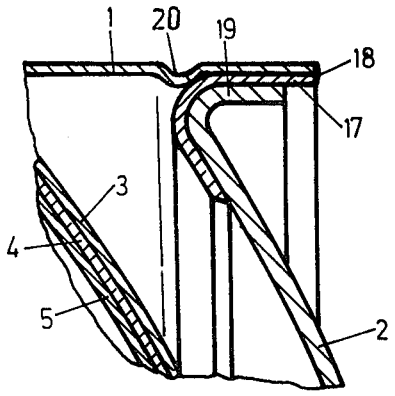
FIG. 2 shows an enlarged fragmentary section of FIG. 1, illustrating the welding of the window along the edge of the ray inlet surface.

In the enlarged fragmentary sectional view in FIG. 2, there is shown a section through the rim or edge of window 2. Herein may be ascertained the positioning of, between a 1.3 mm thick aluminum sheet 19 of the inlet window 2 and the wall of tube 1, an 0.5 mm thick layer 17 which is constituted of copper. The latter is welded at its free edge to the rim or edge of tube 1 in a vacuum-tight relationship along welding seam 18. A reduction in the diameter of the side wall is formed, as shown by the encompassing bead 20, so as to provide a contact for the secure retention of the window 2 for effecting its positioning and welding. In manufacturing the window 2, a two-layer material is utilized, which comprises the 1.3 mm thick aluminum sheet 19 of the aperture 2, and the 0.5 mm thick copper layer 17. In order to obtain the window 2 as shown in the figure of the drawing, this material is pressed into the utilized calotte form, whose edge is bent over towards the curved side. The external diameter, which is measured at the outer wall of the copper layer 17, is conformed to the inner wall diameter of the tube 1. Subsequently, on the concave surface of the window 2, up to 10 mm is removed through turning after bending over of the copper, and at the inner wall after bending over from the edge approximately 2 mm through removal of the aluminum. This will then provide a portion weldable to the edge of the tube 1 along the seam 18 formed by the layer 17 of copper, and in the middle an aluminum sheet surface 19 adapted to be penetrated by X-rays with only a negligible loss.

In lieu of the illustrated window having a flanged or bent over edge, wherein in comparison with known tubes the side walls are only slightly lengthened, the mounting of the window may also be effected along a planar, sidewise directed edge (planar flange). This will provide a tube without elongation, since the weld now is located on the side edge of the tube instead of on the front surface.

The formed component from which the window is constructed, in a variation of the illustrated embodiment of the invention need not directly terminate at the sidewise transition toward the longitudinal wall of the tube 1. Thus, it may be much more advantageous that the formed component be shaped as a cap, into which a portion of the side wall of the tube is inserted, so that the weld, in lieu of at seam 18, lies somewhat toward one side of the electrode 7 at the transition of the larger diameter of the tube 1 into the smaller diameter thereof. The covering of weldable material, when using layered material need be removed only from the window area located in front of the cathode arrangement 3 through 5 and penetrated by the rays, while the light metal need only be removed from the area which is to be welded. As required, the calotte 3 may serve in the image amplifier tube-bulb, in a known manner, as the previously mentioned see-through area of the window.

While there has been shown what is considered to be the preferred embodiment of the invention, it will be obvious that modifications may be made which come within the scope of the disclosure of the specification.

What is claimed is:

1. In ray-penetrating windows for high-vacuum tubes, the use of X-ray penetrable window panes weldable into heavy-metal frames, said panes being each constituted of a layered plate formed of two integrally connected layers formed by rolling under high pressure, one said layer being a light-weight metal excluding beryllium having a density of less than 4.5 g/cm$^3$, and the other layer being a heavy-weight metal having a density of more than 4.5 g/cm$^3$, said heavy-weight metal being removed from the center of said light-weight metal layer towards the edge region thereof and said light-weight metal layer being removed from the edge of said heavy-weight metal layer so as to form an overlapping two-layered portion, the heavy-weight metal edge providing a vacuum tight connection to said frames, said pane being insertable into said frames and said heavy-weight metal edge portion being weldable thereto.

2. A window as claimed in claim 1, said light-weight metal layer being aluminum and said heavy-weight metal layer being copper.

3. A window as claimed in claim 1, comprising a preformed component constituted of an aluminum-copper two-layered material, said window being provided with an X-ray penetrable central portion by having the copper layer removed therefrom, and having the aluminum layer removed from the edges thereof.

4. A window as claimed in claim 1, said frame being steel and forming a portion of said vacuum tube for an image amplifier tube.

5. A window as claimed in claim 4, said window portion facilitating penetration of said rays being located within said light-weight metal portion, said overlapping two-layered portion engaging part of the side wall of said tube intermediate said window portion and the weldable edge thereof.

6. A window as claimed in claim 1, comprising an outwardly flanged edge fitted into said frame against relative displacement therewith, said window flanged edge and frame being welded to each other.

7. In ray-penetrating windows for high-vacuum tubes, the use of X-ray penetrable window panes weldable into heavy-metal frames, said panes being each constituted of a layered plate formed of two integrally connected layers, one said layer being a light-weight metal having a density of less than 4.5 g/cm$^3$, and the other said layer being a heavy-weight metal having a density of more than 4.5 g/cm$^3$, said heavy-weight metal being removed from the center of said light-weight metal layer towards the edge region thereof and said light-weight metal layer being removed from the edge so as to form an overlapping two-layered portion, the heavy-weight metal edge providing a vacuum tight connection to said frames, said pane being insertable into said frames and said heavy-weight metal edge portion being weldable thereto, said light-weight metal layer being aluminum and said heavy-weight metal layer being iron.

8. In ray-penetrating windows for high-vacuum tubes, the use of X-ray penetrable window panes weldable into heavy-metal frames, said panes being each constituted of a layered plate formed of two integrally connected layers, one said layer being a light-weight metal having a density of less than 4.5 g/cm$^3$, and the other said layer being a heavy-weight metal having a density of more than 4.5 g/cm$^3$, said heavy-weight metal being removed from the center of said light-weight metal layer towards the edge region thereof and said light-weight metal layer being removed from the edge so as to form an overlapping two-layered portion, the heavy-weight metal edge providing a vacuum tight connection to said frames, said pane being insertable into said frames and said heavy-weight metal edge portion being weldable thereto, said light-weight metal layer being titanium and said heavy-weight metal layer being copper.

* * * * *